US005531564A

United States Patent [19]

Anttonen et al.

[11] Patent Number: 5,531,564

[45] Date of Patent: Jul. 2, 1996

[54] CENTRIFUGAL PUMP

[75] Inventors: Kari Anttonen, Karhula; Seppo Hokkanen, Tavastila; Jukka Timperi, Kotka, all of Finland

[73] Assignee: A. Ahlstrom Corporation, Noormarkku, Finland

[21] Appl. No.: 386,491

[22] Filed: Feb. 10, 1995

[30] Foreign Application Priority Data

Feb. 11, 1994 [FI] Finland ..... 940630

[51] Int. Cl.[6] ..... F01D 3/00

[52] U.S. Cl. ..... 415/104; 415/170.1; 416/198 A

[58] Field of Search ..... 415/104, 107, 415/170.1; 416/204 R, 198 A

[56] References Cited

U.S. PATENT DOCUMENTS

| | | | |
|---|---|---|---|
| 1,045,019 | 11/1912 | Gottschling | 415/104 |
| 3,031,973 | 5/1962 | Kramer | 415/104 |
| 3,280,750 | 10/1966 | White | 415/104 |
| 4,477,227 | 10/1984 | Klufas | 416/198 A |
| 4,511,307 | 4/1985 | Drake | 415/170.1 |

FOREIGN PATENT DOCUMENTS

| | | | |
|---|---|---|---|
| 79577 | 7/1955 | Denmark . | |
| 121053 | 10/1984 | European Pat. Off. . | |
| 461131 | 12/1992 | European Pat. Off. . | |
| 529379 | 3/1993 | European Pat. Off. . | |
| 496605 | 4/1930 | Germany . | |
| 895102 | 10/1953 | Germany . | |
| 902942 | 1/1954 | Germany . | |
| 1504370 | 8/1989 | U.S.S.R. | 415/104 |

*Primary Examiner*—John T. Kwon

*Attorney, Agent, or Firm*—Nixon & Vanderhye

[57] ABSTRACT

A multi-stage centrifugal pump has a shorter shaft length compared to conventional multi-stage pump with the same number of impellers on the drive shaft (e.g. about 17–28% shorter length). The shorter length is obtained by utilizing first and second annular slide bearings. Adjacent at least one end (and preferably both) of a rotatable elongated shaft of the pump (which mounts the impellers) within a casing the first slide bearing is mounted to a stationary end structure while the second slide bearing is mounted to the shaft for rotation with it. A plurality of O-rings may be provided to mount the second slide bearing to the shaft. A sleeve with shoulder engaging opposite ends of the second slide bearing may be provided, and the slide bearings may have a clearance of about 0.04–0.1 mm between them, with a lubricant in the clearance. A labyrinth seal is typically provided in the most remote shoulder. The slide bearings are of silicon carbide or a similar material, and have a length (in the dimension of elongation of the shaft) of about 10 cm or less. The impellers may be mounted to the shaft without keys by providing polygonal protrusions concentric with the shaft formed on the impellers and cooperating with similarly shaped polygonal recesses in an adjacent impeller.

22 Claims, 5 Drawing Sheets

CENTRIFUGAL PUMP

BACKGROUND AND SUMMARY OF THE INVENTION

Conventional multi-stage centrifugal pumps provide a plurality of impellers on the same shaft, and produce a high pressure head. Sealing, supporting and guiding the shaft (with bearings), and the balancing of axial forces at the non-driven end of such pumps, are typically complicated procedures. For example in some conventional constructions the non-driven end of the shaft is mounted by a pair of tapered roller bearings which are spaced a significant distance from the pump itself since sealing of the pump is carried out by a conventional packing (which is relatively long). Since the packing must be occasionally replaced, it must be possible to remove the packing. A balancing drum is preferably also provided between the packing and the last impeller on the shaft, for balancing a majority of the axial forces generated by the pump. Centrifugal pumps always generate an axial force causing the impellers to move toward the suction channel. The balancing drum typically has a labyrinth seal, and between the cylindrical surfaces of the balancing drum there is a gap of about 0.05 mm. The pressure generated by the pump is introduced into the cavity between the last impeller and the balancing drum so that the pressure of the pump against the balancing drum tends to push the balancing drum further away from the impeller. The force that is thus generated is counter-directional to the axial force generated by pumping so that the axial force loading the bearings of the pump is the difference between the axial forces having different directions.

In most conventional multi-stage centrifugal pumps the length of the actual pump (shaft and impellers) is only about 55% of the total length of the apparatus. A substantial portion of the length of the entire assembly is due to the spaced location of the bearings at the non-driven end as a result of the packing construction. This requires a sturdier and longer shaft than is desired, the sturdier construction being necessary to resist the bending load on the shaft because of its length.

According to the present invention about 20% (e.g. about 17–28%) of the length of a conventional multi-stage centrifugal pump assembly is saved by providing the balancing, bearing, and sealing functions in a simplified manner.

According to one aspect of the present invention a multi-stage centrifugal pump is provided comprising the following elements: A rotatable elongated shaft having first and second ends. A casing including a stationary end structure, an inlet for fluid to be pumped, and an outlet for pumped fluid. A plurality of impellers mounted on the shaft within the casing, for rotation with the shaft. And, adjacent at least one end of the shaft within the casing first and second annular slide bearings, the first slide bearing mounted to the stationary end structure, and the second slide bearing mounted to the shaft for rotation therewith. The second slide bearing may be mounted to the shaft for rotation therewith by one or more flexible mounting devices, such as a plurality of O-rings. A sleeve may also be mounted to the shaft for rotation with it, the sleeve provided between the O-rings and the shaft. First and second shoulders may be connected to the sleeve and engage opposite ends of the second slide bearing for positively positioning it within the end structure, and the second shoulder, on the opposite side of the second slide so bearing from the impellers, may have a labyrinth seal.

Typically there is a clearance between the first and second slide bearings of about 0.04–0.1 mm (preferably about 0.05 mm), and a lubricant (such as the pumped fluid) is provided in the clearance. The slide bearings may be made of silicon carbide, antimony carbide, carbon impregnated polytetrafluoroethylene, or a similar material which performs a bearing function over a long period of time without degradation, and has good lubrication properties. The lubricant typically forms a liquid film on the bearing surfaces, which provides good lubrication.

According to another aspect of the present invention a multi-stage centrifugal pump is provided comprising the following components: A rotatable elongated shaft having first and second ends. A casing including a stationary end structure, an inlet for fluid to be pumped, and an outlet for pumped fluid. A plurality of impellers mounted on the shaft within the casing, for rotation with the shaft. And, means for simultaneously balancing axial forces in the casing, sealing the pump at the end structure, and supporting and guiding the shaft during rotation in the casing, the means comprising first and second annular slide bearings. The first and second annular slide bearings and associated components may be constructed as described above.

Another problem associated with conventional multi-stage centrifugal pumps is that each impeller is mounted to the shaft by way of a separate key in a keyway. The keyways are typically circumferentially equally spaced apart from each other, e.g. within about 120° from each other, in the shaft. The manufacture of multi keyways is expensive and time consuming because the rounded ends of the keyways must be machined and that is a relatively complicated operation. Also shaft deformation can occur in a keyway, and other disadvantageous results may occur.

According to another aspect of the present invention problems associated with keying each of the impellers of a centrifugal pump to the shaft are avoided by providing a connection between at least some of the impellers to each other which takes the place of keying. For example at least some of the impellers may be mounted to the shaft by polygonal protrusions concentric with a shaft cooperating with similarly shaped polygonal recesses in an adjacent impeller. Therefore only one or two of the impellers need be keyed or otherwise attached to the shaft, and no keyways are necessary for the impellers connected to each other; or one or more sleeves cooperating with the impellers may be keyed or otherwise attached to the shaft so that no keyways for impellers are necessary at all.

Thus according to another aspect of the present invention a multi-stage centrifugal pump is provided comprising: A rotatable elongated shaft having first and second ends. A casing including an end structure, an inlet for fluid to be pumped, and an outlet for pumped fluid. A plurality of impellers mounted on the shaft within the casing, for rotation with the shaft. And, at least some of the impellers being mounted to the shaft by polygonal protrusions concentric with the shaft cooperating with similarly shaped polygonal recesses in an adjacent impeller, the impellers themselves devoid of key connections directly to the shaft.

It is the primary object of the present invention to provide an improved multi-stage centrifugal pump. This and other objects of the invention will become clear from an inspection of the detailed description of the invention, and from the appended claims.

DETAILED DESCRIPTION OF THE DRAWINGS

Figure 1:
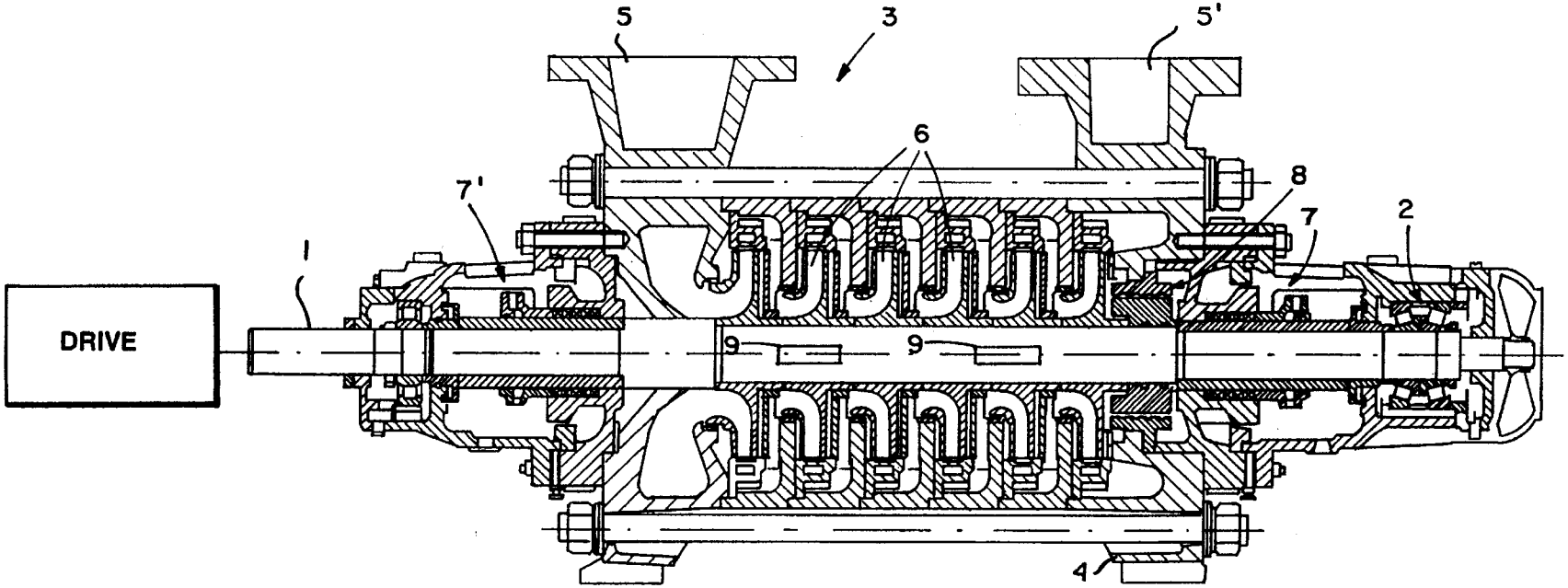
FIG. 1 PRIOR ART
FIG. 1 is a longitudinal view, partly in cross-section and partly in elevation, of one embodiment of a conventional prior art multi-stage centrifugal pump.

FIG. 1 illustrates an exemplary conventional multi-stage centrifugal pump 3 having an elongated shaft 1 driven by a drive mechanism at one end thereof, and mounted by a bearing assembly 2 at the non-driven end thereof. As seen in FIG. 1 the bearing assembly 2 comprises two tapered roller bearings positioned to face each other, and supporting a small share of the axial forces generated during the operation of the pump 3. The shaft 1 is mounted for rotation with respect to a casing 4 having an inlet 5 for fluid to be pumped and an outlet 5' for pumped fluid. A plurality of impellers 6 are mounted to the shaft 1, typically being keyed thereto.

Adjacent the roller bearings 2 on the right hand (non-driven) end of the shaft 1 of FIG. 1 is a conventional packing 7 which performs a sealing function. (Another packing 7' is provided at the opposite end of the shaft 1, also illustrated in FIG. 1.) The packing 7 is relatively long. The bearing 2 is positioned in the way that it is because it is necessary to provide a sufficient space to allow the packing 7 to be replaced. Between the packing 7 and the impellers 6 is a balancing drum assembly 8.

The balancing drum assembly 8 balances the majority of the axial forces generated by the pump 3. The pump 3 always generates an axial force, causing the impellers 6 to move toward the suction channel (inlet 5) as a result of the impellers 6 drawing the fluid to be pumped from the suction channel. Since the pumping direction is from axial to radial, nothing compensates for this transfer tendency unless a structure like the balancing drum assembly 8 is provided. The balancing drum assembly 8 typically includes an annular member rotating with the shaft which has a labyrinth seal and cooperates with a counter member on the body (casing 4) of the pump 3. The labyrinth seal is provided by annular grooves and the gap between the rotating and non-rotating members of the conventional balancing drum assembly 8 is about 0.5 mm. Thus a small flow of liquid being pumped flows into the gap, decelerating due to the effects of the grooves of the labyrinth seal, and at the same time the grooves create a liquid film between the surfaces preventing them from coming into mechanical contact with each other. The pressure generated by the pump 3 is thus introduced into the cavity between the last impeller 6 and the balancing drum assembly 8 so that the pressure of the pump against the balancing drum assembly 8 tends to push the balancing drum assembly 8 further away from the impeller 6. The force that is thus generated is counter-directional to the axial force generated by pumping. The axial force loading on the bearings of the pump 3 is thus the difference between the axial force provided by the pumping action and the counter-directional force provided by the balancing drum assembly 8.

For A. Ahlstrom Corporation pumps, the length of the packing 7 and bearing 2 assembly (pump 3, FIG. 1) is typically about 300 mm. The length of a pump 3 itself is about 1400 mm if it has 14 stages (impellers) and about 770 mm if it has 3 stages (impellers).

Figure 2:
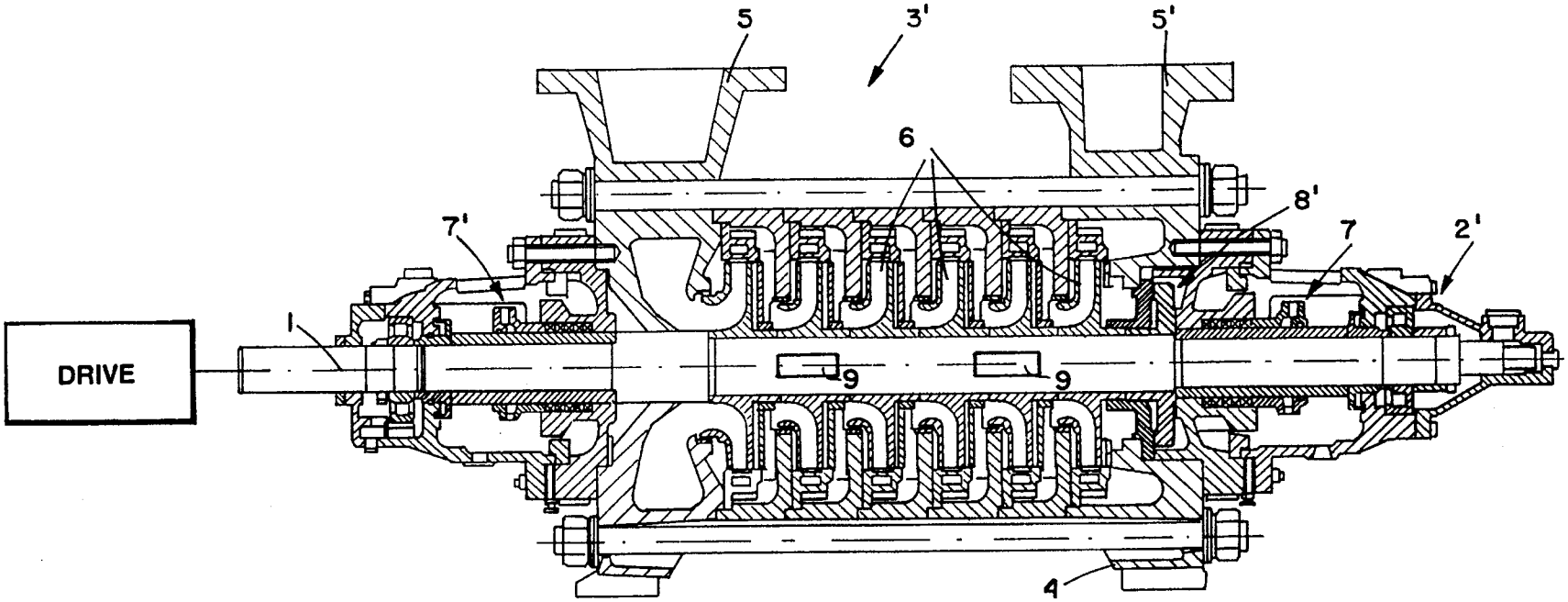
FIG. 2 PRIOR ART
FIG. 2 is a view like that of FIG. 1 for a modified form of a conventional multi-stage centrifugal pump.

FIG. 2 illustrates another construction of a conventional multi-stage centrifugal pump 3'. The pump 3' is substantially identical to the pump 3 of FIG. 1 except for the particular balancing element and external bearing, and components from the two figures that are in common are shown by the same reference numerals.

The balancing structure 8', between the packing 7 and the last impeller 6 in FIG. 2 comprises a balance disc assembly, which is a conventional assembly which functions in basically the same way as the balancing drum 8 of FIG. 1, only the rotating and cooperating components have a different construction. Also in the embodiment of FIG. 2 the bearing 2' is not a roller bearing of the same type as illustrated in FIG. 1, but is a different type of so conventional bearing.

The constructions of both FIGS. 1 and 2 are sealed, and typically the impellers 6 are connected to the shaft 1 by keys and keyways. Exemplary keyways are shown by reference numeral 9 in FIGS. 1 and 2. The keyways 9 are typically circumferentially equally spaced apart around the periphery of the shaft 1 (e.g. every 120°) and cooperate with keys (not shown) on the impellers 6. It is a very practical problem to produce these multiple keyways 9 in a shaft 1, providing an expensive and time consuming manufacturing process because the rounding of the ends of the keyways 9 is a relatively complicated operation even using modern machining methods. Also deformation of the shaft 1 occurs at the edges of the keyways, the shaft not being round thereat but rather a ridge-like protrusion being provided due to the deformation of the metal during machining.

The provision of the keyways 9 also considerably reduces the fatigue strength of the shaft 1, increasing potential fatigue fractures. Therefore it is often necessary to provide the shaft 1 of a more robust construction than if the keyways 9 were not present, and/or the shaft 1 must be treated in a particular way (heat treated) so as to better resist fatigue fractures. The stresses resulting from heat treatment, however, may have further negative affects, such as causing the shaft to bend during use more than is desired.

Further drawbacks of multiple keyways 9 are also present. For example the keys may jam in the keyways 9. Since the key is used to transfer the torsional movement from the shaft 1 to an impeller 6 a shear stress is generated in the key which can break the key and cause the impeller 6 to jam on the shaft 1. In this way the removal of the impeller 6 from the shaft 1 for maintenance or repair is difficult if not impossible, and the assembly of the pump 3, 3' is difficult because the keys must have a relatively tight fit.

According to the present invention it is desired to minimize the length of the pump 3, 3', of the prior art constructions such as illustrated in FIGS. 1 and 2, and also to mount the impellers 6 to the shaft 1 in a manner that does not require multiple keyways 9 to be formed. The length of the pump assembly 3 may be reduced, according to the present invention, by about 20% (e.g. between about 17–28% for fourteen stage to three stage pumps, respectively), with subsequent and corresponding reduction in the length of the shaft. That reduction in shaft length, combined with the elimination of multiple keyways, allows a much simpler and less expensive shaft construction.

Figure 3:
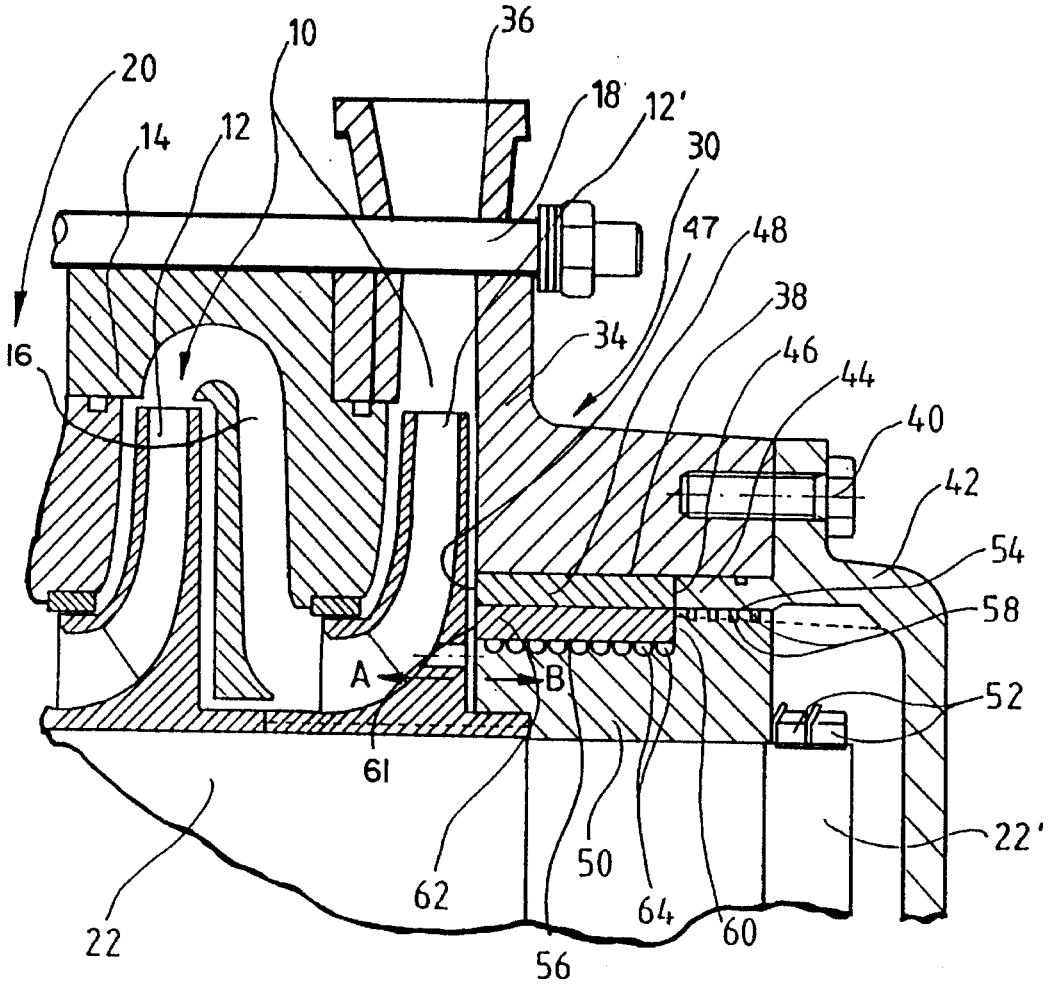
FIG. 3 is a schematic detail view, primarily in cross-section but partly in elevation, of the portion of a multi-stage centrifugal pump according to the present invention that differs from the pumps of FIGS. 1 and 2.

FIG. 3 illustrates one aspect of the present invention, showing the non-driven end of a multi-stage centrifugal pump. In FIG. 3 the discharge channel 36 is a pump outlet that corresponds generally to the pump outlet 5' in FIGS. 1 and 2, and the casing or housing 30 corresponds to the casing or housing 4 of FIGS. 1 and 2. Note that in FIG. 3 instead of a long extended structure at the pressure end of the pump assembly a short, simple end structure 42 is provided in which the end 22' of the shaft 22 is positioned.

FIG. 3 illustrates individual pump units 10 of a multi-stage centrifugal pump disposed in succession along the drive shaft 22 (comparable to the drive shaft 1 in the FIGS. 1 and 2 embodiments) between a suction end 20 and a pressure end (discharge channel 36). Each pump unit 10 comprises an impeller 12 (comparable to the impeller 6 in FIGS. 1 and 2) and a casing ring 14 which defines a flow channel 16 through which the fluid to be pumped is forced by the impeller 12 from the vicinity of the shaft 22 radially outwardly to the next stage 10. Bolts 18 connect together the individual pump units 10 forming part of the casing 30 which includes an inlet (Nike the inlet 5 in FIG. 1) and the outlet 36 (comparable to the outlet 5' in FIG. 1).

An axial stationary end structure 34 is provided which includes the outlet 36 and surrounds the shaft 22. The inner annular surface 38 of the end structure 34 is co-axial with the shaft 22. An end cover 42, e.g. mounted with screws 40 to end structure 34, and having a cylindrical extension 44, defines the termination of the end structure 34. The cylindrical extension 44 extends inwardly parallel to the shaft 22 along the surface 38 toward the impellers 12. While the end cover 42 is seen in FIG. 3 as being a distinct structure connected by the screws 40 to the end structure 34 it is to be understood that it could be integral therewith.

According to the embodiment of FIG. 3, means are provided for simultaneously balancing axial forces in the casing containing the pump units 10, sealing the pump at the end structure 34, and supporting and guiding the shaft during rotation about its axis within the casing. Such means, by providing these multiple functions in a simple and straightforward manner, allow substantial reduction in the size of the pump compared to the conventional structure such as seen in FIGS. 1 and 2. For example comparing FIG. 3 to FIGS. 1 and 2 it will be seen that essentially the entire structure past where the packing 7 is provided in FIGS. 1 and 2 is eliminated, i.e. a reduction of about 300 mm in total length. For a three stage pump this is a reduction of $^{300}/_{1070}$=about 28%, and for a fourteen stage pump a reduction of $^{300}/_{1700}$=about 17%.

The means for simultaneously balancing, sealing the pump, and supporting and guiding the shaft 22, according to the present invention, preferably comprises the annular slide bearings (bearing rings) 48, 62. The first slide bearing 48 engages the surface 38 of the so end structure 34, and the end 46 thereof most remote from the impellers 12 is abutted by the protrusion 44. The opposite (to the end 46) end 47 of the annular slide bearing 48 is adjacent the last impeller 12' (from the drive motor), substantially in line with the left end of the housing structure 34 as seen in FIG. 3.

The end 22' of the shaft 22 is within the end cover 42. In the FIG. 3 embodiment a sleeve 50 is disposed between the shaft 22 and the second annular slide bearing 62. The sleeve 50 is held to the shaft 22 to rotate therewith, as by lock nuts 52, or a comparable locking structure.

The outer surface of the sleeve 50 is divided into two parts, 54 and 56. The part 54 has a larger diameter and is preferably sealed with a labyrinth seal 58 relative to the inner surface of the extension 44 of the end cover 42. When the end cover 42 is part of the end housing 34, sealing takes place with respect to a corresponding is surface of the end structure 34.

The second, inner, annular slide bearing 62 is supported by the outer surface of part 56 of the sleeve 50. The bearing ring 62 is preferably connected to the surface 56, and thus the sleeve 50 and the shaft 22 (for rotation therewith), by one or more flexible mounting devices. For example for the embodiment illustrated in FIG. 3 the one or more flexible mounting devices comprises a plurality of O-rings 64 which prevent relative rotation between elements 62, 50. The bearing ring 62 has a first end surface 60 which is preferably substantially in alignment with the end surface 46 of the first bearing ring 48 and abuts the larger part 54 of the sleeve 50, while the opposite end 61 thereof is substantially in alignment with the end 47 of the first bearing ring 48.

The bearing rings 48, 62 are preferably of silicon carbide, antimony carbon, or carbon impregnated polytetrafiuoroethylene, or so other materials having comparable properties facilitating the use of the annular slide bearings 48, 62 as structures providing guidance and support for rotation of the shaft 22 while simultaneously sealing the pump and balancing axial forces. Lubrication may be provided for the bearings 48, 62, for example by high pressure fluid pumped by the pump which flows into the clearance volume between the last impeller 12' and the end structure 34, which flow of fluid facilitates the balancing of axial loads by the bearing rings 48, 62. A small clearance, on the order of about 0.04–0.1 mm (preferably about 0.05 mm), which is too small to be seen in FIG. 3, is provided between the bearing rings 48, 62 into which the fluid being pumped is forced, forming a liquid film which lubricates the cooperating surfaces of the bearing rings 48, 62. The bearing rings 48, 62 typically are about ten centimeters or less in length (the dimension parallel to the dimension of elongation of the shaft 22).

FIG. 3 illustrates an arrow A in the direction of the axial force caused by the impellers 12 effecting pumping, while the arrow B illustrates the force resisting the axial force in direction A. Force B results from the pressure prevailing between the last impeller (12' in FIG. 3) and the end structure 34, this pressure acting on the sleeve 50 on the shaft 22 and the second, inner, bearing ring 62. Typically the extent of the balancing force B is about 95% of the axial force A of the impellers 12. The force B is generated by the functional cooperation of the ring bearings 48, 62.

Figure 4:
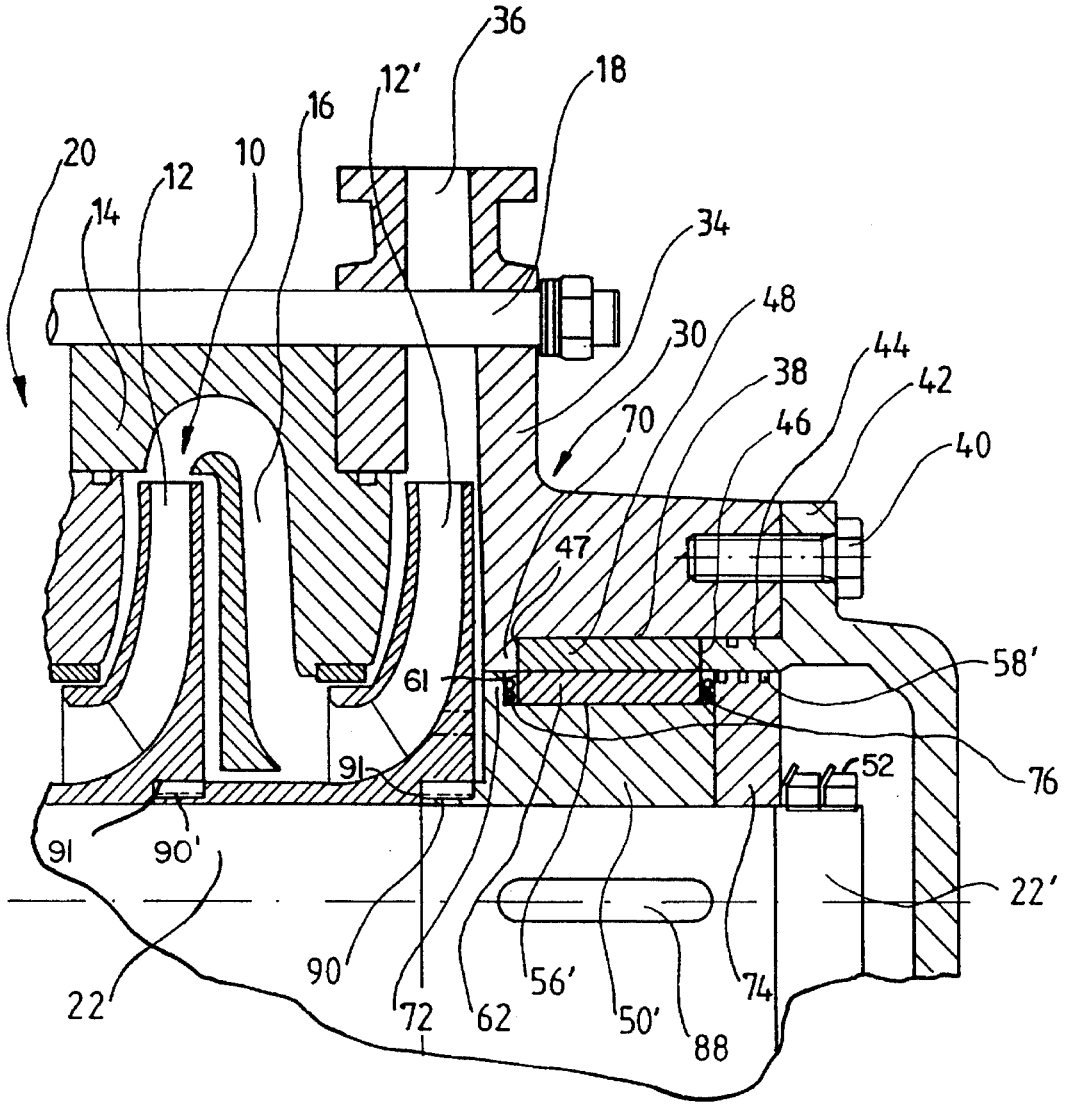
FIG. 4 is a view like that of FIG. 3 for another embodiment according to the present invention.

FIG. 4 illustrates another embodiment of a balancing/bearing structure according to the present invention. In FIG. 4 structures comparable to those in FIG. 3 are shown by the same reference numeral.

In FIG. 4 the end structure 34' is formed with an inner annular shoulder 70 which is engaged by the end 47 of the first bearing 48. Also the sleeve 50' is slightly different than the sleeve 50, having an inner annular shoulder 72 which cooperates with the shoulder 70 and is abutted by the inner end 61 of the second bearing 62. At the opposite end of the sleeve 50' from the shoulder 72 is a clamping sleeve element 74 which is sealed with a labyrinth seal 58 to the end cover 42 cylindrical extension 44. The clamping sleeve element 74 thus has an outer diameter approximately the same as that of the shoulder 72 of the sleeve 50'. The space along the dimension of elongation of the shaft 22 between the shoulder 72 and the clamping sleeve element 74 is slightly longer than the length of the bearing ring 62 to receive one or more O-rings 76, or a like flexible mounting device, for mounting the bearing ring 62 so that it rotates with the sleeve 50' and shaft 22.

Because the bearing rings 62, 48 function as a seal in addition to functioning as bearings and for balancing the axial forces, it is important that the cooperating surfaces of the bearing rings 48, 62 (the surfaces facing each other) are absolutely smooth and absolutely parallel. This is provided for in both the FIGS. 3 and 4 embodiments in part by the flexible mounting provided by the O-rings 64, 76, or like flexible mounting devices, which allow minimal movement so as to compensate for minor non-parallelity of the cooperating surfaces of the rings 48, 62. While a flexible mounting device has been illustrated in FIGS. 3 and 4 only for the second, inner, annular slide bearing 62, it is to be understood that a similar flexible mounting device (e.g. O-rings) may be provided alternatively, or in addition, for the first, outer, annular slide bearing 48 (to ensure that it remains stationary, along with end structure 34, 34').

Figure 5A:
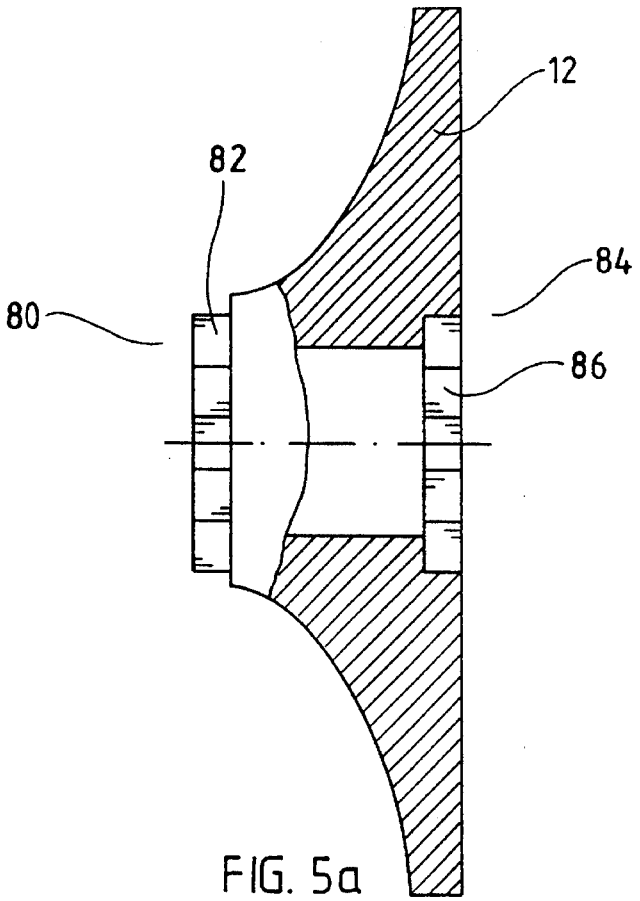
FIG. 5*a* is a side view, partly in cross-section and partly in elevation, of an exemplary impeller that may be utilized in a multi-stage centrifugal pump according to the present invention.
Figure 5B:
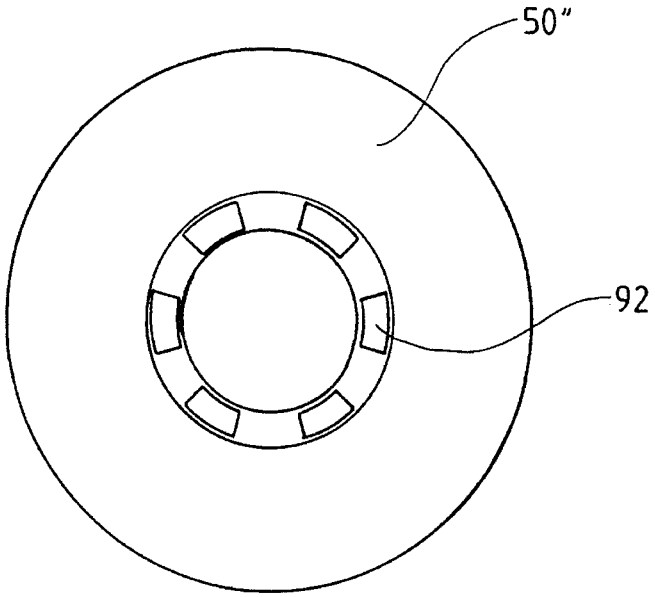
FIG. 5*b* is an end view of a sleeve according to the present invention which has protrusions cooperating with the impeller of FIG. 5*a* which may comprise a modification of the sleeve and impeller construction of FIG. 4.

FIGS. 4, 5*a* and 5*b* show various structures that may be utilized to mount the impellers 12 without multiple keyways in the shaft. For example as seen in FIG. 4 a single keyway 88 is provided in the shaft 22, which receives a key (not shown) of the sleeve 50'. Rather than the impellers 12 being mounted by keys and keyways, they are mounted for rotation with the shaft 22 by the protrusions 90 (which typically collectively define a polygonal shape) extending axially inwardly from the sleeve 50' toward the last impeller 12'; the protrusions 90 being spaced uniformly around the circumference of the sleeve 50'. Protrusions 90 engage cooperating recesses 91 in the rightmost end of the last impeller 12', the cooperation between the projections 90 and recesses 91 effecting rotation of the impellers 12, 12' upon rotation of the shaft 22, through the key received in the keyway 88 and the sleeve 50'. Protrusions 90' are formed at the leftmost end of each of the impellers 12', 12 cooperating with similar recesses 91 in an adjacent impeller 12.

FIG. 5*a* shows another form of an impeller 112 comparable to the impellers 12, 12' only having a slightly different protrusion and recess construction, but performing the same function (that is tying together the impellers 112 along a shaft, like the shaft 22, so that a separate keyway need not be provided for each impeller 112). The front edge 80 of each impeller 112 is provided with locking means 82 and the opposite edge 84, i.e. the trailing edge with counter locking means 86 operating with locking means 82. For example a polygonal protrusion 82 is provided at the front edge 80 of the impeller 112 and a polygonal recess 86 corresponding to said protrusion 82 at the trailing edge 84 of the impeller 112.

Also cogs 92 fitting into cooperating recesses may alternatively be used as a locking means between impeller 112 (see FIG. 5*b*; illustrated with the torque transfer device 50" comparable to the sleeve 50' illustrated in FIG. 4), pins, or the like fitting the perforations, i.e. the mounting arrangement is based upon profile locking. Whatever the locking arrangements between the impellets 12, 112, it is important that they allow the impellers to be separated from each other without the need for a special tool and without the necessity of machining the shaft 22 of the pump. In this way there are no protrusions or grooves associated with the shaft or the inner surface of the impellers which would cause stress peaks.

While FIG. 4 illustrates locking of the impellers 12, 12' using the single keyway 88, a comparable keyway and sleeve may be provided at the drive end of the shaft 22. A sleeve at the drive end would of course have a recess rather than a protrusion to receive the protrusion from the leftmost (as seen in FIG. 4) impeller 12. In such a circumstance there is still no need for a keyway associated with each impeller 12, but rather merely two keyways at opposite ends of the shaft 22.

Another manner in which the impellers 12 may be mounted to the shaft 22 is to provide a structure having a larger diameter than the drive end of the shaft, or at the opposite end (as illustrated in FIG. 4). This enlarged diameter member may fit within a mounting interior structure of an impeller, or to an intermediary member like the sleeve 50', so that the keyway 88 may be eliminated. The impellers connected to each other subsequently on the shaft may be secured by nuts and bolts, or like structures, to each other. Alternatively such an enlarged structure may be provided at a central portion of the shaft with impellers on opposite sides thereof connected together by nuts and bolts, or the like.

It will thus be seen that according to the present invention a highly advantageous multi-stage centrifugal pump has been provided. Because the annular slide bearings 48, 62 typically at most have a length in the dimension of elongation of the shaft 22 of about ten centimeters, and because the external bearings 2, packings 7, 7', and like structures of the conventional multi-stage centrifugal pumps of FIGS. 1 and 2 are eliminated, pumps according to the present invention have a length in the dimension of elongation of the shaft 22 that is about 20%, (e.g. about 17–28%) less than the pumps of FIGS. 1 and 2. This allows a shorter shaft 22, allowing it to have a simpler and less expensive—or alternatively more robust for a given pump size—construction than for the conventional pumps of FIGS. 1 and 2. Also as described particularly with respect to FIGS. 4, 5*a*, and 5*b*, according to the invention a separate keyway need not be provided in the shaft for each of the impellers 12, 112 but rather no keyways at all, or merely one or two keyways at an end or both ends of the shaft 22, associated with sleeves (e.g. like sleeve 50'), need be provided. This extends the life of the shaft, allows it to be simpler, less expensive, and/or has other advantages as described above.

While the invention has been herein shown and described in what is presently conceived to be the most practical and preferred and embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A multi-stage centrifugal pump comprising:

a rotatable elongated shaft having first and second ends;

a casing including a stationary end structure, an inlet for fluid to be pumped, and an outlet for pumped fluid;

a plurality of impellers mounted on said shaft within said casing, for rotation with said shaft; and adjacent at least one end of said shaft within said casing first and second annular slide bearings, said first slide bearing mounted to said stationary end structure, and said second slide bearing mounted to said shaft for rotation therewith, and at least one of said slide bearings mounted by one or more flexible mounting devices.

2. A pump as recited in claim 1 wherein said second slide bearing is mounted to said shaft for rotation therewith by one or more flexible mounting devices.

3. A pump as recited in claim 2 wherein said one or more flexible mounting devices comprise a plurality of O-rings.

4. A pump as recited in claim 3 further comprising a sleeve mounted to said shaft for rotation therewith, said sleeve provided between said O-rings and said sleeve.

5. A pump as recited in claim 4 further comprising first and second shoulders connected to said sleeve and engaging opposite ends of said second slide bearing for positively positioning said second slide bearing within said end structure.

6. A pump as recited in claim 5 wherein said second shoulder is on the opposite side of said second slide bearing from said impellers, and wherein said second shoulder comprises a labyrinth seal.

7. A pump as recited in claim 1 wherein there is a clearance between said first and second slide bearings of about 0.04–0.1 mm, and a lubricant is provided in the clearance.

8. A pump as recited in claim 2 wherein there is a clearance between said first and second slide bearings of about 0.05 mm, and a lubricant is provided in the clearance.

9. A pump as recited in claim 1 further comprising a shoulder engaging said second bearing on the opposite side of said second bearing from said impellers, said shoulder sealed with respect to said end structure.

10. A pump as recited in claim 9 wherein said shoulder is sealed with respect to said end structure by a labyrinth seal.

11. A pump as recited in claim 1 wherein at least some of said impellers are mounted to said shaft by polygonal protrusions concentric with said shaft cooperating with similarly shaped polygonal recesses in an adjacent impeller.

12. A pump as recited in claim 1 wherein said slide bearings are made of silicon carbide, antimony carbon, or carbon impregnated polytetrafluoroethylene.

13. A pump as recited in claim 1 wherein slide bearings each have a maximum length in the dimension of elongation of said shaft of about ten centimeters or less.

14. A pump as recited in claim 1 wherein said shaft is supported in said casing at said first and second ends of said shaft by said slide bearings, said impellers disposed between said slide bearings.

15. A multi-stage centrifugal pump comprising:

a rotatable elongated shaft having first and second ends;

a casing including an end structure, an inlet for fluid to be pumped, and an outlet for pumped fluid;

a plurality of impellers mounted on said shaft within said casing, for rotation with said shaft; and means for simultaneously balancing axial forces in said casing, sealing said pump at said end structure, and supporting and guiding said shaft during rotation in said casing, said means comprising first and second annular slide bearings, and at least one of said slide bearings mounted by one or more flexible mounting devices.

16. A pump as recited in claim 15 wherein said second slide bearing is mounted to said shaft for rotation therewith by one or more flexible mounting devices.

17. A pump as recited in claim 15 further comprising a sleeve mounted to said shaft for rotation therewith, said sleeve provided between said shaft and said second bearing, and first and second shoulders connected to said sleeve and engaging opposite ends of said second bearing for positively positioning said second bearing within said end structure.

18. A pump as recited in claim 17 wherein at least one of said shoulders is sealed with respect to said end structure by a labyrinth seal.

19. A pump as recited in claim 15 wherein said slide bearings are made of silicon carbide, antimony carbon, or carbon impregnated polytetrafluoroethylene, and wherein there is a clearance between said first and second slide bearings of about 0.04–0.1 mm.

20. A pump as recited in claim 15 wherein at least some of said impellers are mounted to said shaft by polygonal protrusions concentric with said shaft cooperating with similarly shaped polygonal recesses in an adjacent impeller.

21. A pump as recited in claim 15 wherein said shaft is supported in said casing at said first and second ends of said shaft by said slide bearings, said impellers disposed between said slide bearings.

22. A pump as recited in claim 15 wherein slide bearings each have a maximum length in the dimension of elongation of said shaft of about ten centimeters or less.

* * * * *